United States Patent [19]

Talucci

[11] 4,037,685

[45] July 26, 1977

[54] BUILDING EVACUATION SYSTEM

[76] Inventor: Anthony Talucci, 2045 Valley Drive, Syracuse, N.Y. 13207

[21] Appl. No.: 642,454

[22] Filed: Dec. 19, 1975

Related U.S. Application Data

[63] Continuation-in-part of Ser. No. 613,338, Sept. 15, 1975, abandoned.

[51] Int. Cl.[2] ..... A62B 1/20

[52] U.S. Cl. ..... 182/18; 182/19; 182/48

[58] Field of Search ..... 182/48, 49, 47, 18, 182/19; 193/32

[56] References Cited

U.S. PATENT DOCUMENTS

| | | | |
|---|---|---|---|
| 1,035,871 | 8/1912 | Gardner | 193/32 |
| 1,200,686 | 10/1916 | Youngblood | 182/48 |
| 3,392,380 | 7/1968 | Fordyce | 182/18 |

FOREIGN PATENT DOCUMENTS

| | | | |
|---|---|---|---|
| 517,442 | 2/1953 | Belgium | 182/48 |

*Primary Examiner*—Reinaldo P. Machado

*Attorney, Agent, or Firm*—Charles S. McGuire

[57] ABSTRACT

A system for emergency evacuation of individuals from a multi-story building. A hollow, vertically disposed tube of sufficient cross section to accommodate a person in a sitting position is affixed to the outside of the building, parallel to a side wall, and inclined tubes provide access from a doorway through the building wall at each floor to the interior of the vertical tube. Pivotally mounted platforms are disposed within the tube at vertical intervals of a few feet and attached to weighted lever arms which normally maintain the platforms in a blocking position across the interior of the tube. The weight of an individual will overcome the bias of the counterweight and rotate the platform to an unblocking position, allowing the individual to drop to the next platform. A controlled rate of descent is provided by the time required for the individual's weight to overcome the inertia and biasing force of the counterweights attached to the lever arms at each successively lower level. A number of optional features are also disclosed, including automatic adjustment of the biasing force on the platform in accordance with the weight of each individual, and safety indicators and interlocks.

13 Claims, 9 Drawing Figures

BUILDING EVACUATION SYSTEM

REFERENCE TO RELATED APPLICATION

This is a continuation-in-part of application Ser. No. 613,338, filed Sept. 15, 1975, now abandoned.

FIELD & OBJECTS OF THE INVENTION

The present invention relates to apparatus for emergency evacuation of multi-story buildings, and more specifically to apparatus providing vertical descent at a controlled rate by gravity operation.

It is a principal object of the present invention to provide apparatus for evacuating individuals from a multi-story building in a rapid and efficient manner.

A further object is to provide emergency evacuation apparatus which may be conveniently installed on the exterior of a high rise building without unduly detracting from the appearance thereof.

Another object is to provide emergency evacuation apparatus externally of a building through which individuals may emerge from the building and descend vertically at a controlled rate with no mechanical power supplied to the apparatus.

Other objects will in part be obvious and will in part appear hereinafter.

SUMMARY OF THE INVENTION

In accordance with the foregoing objects, the invention comprises a hollow tube of cross section large enough to accommodate an individual in a sitting position, affixed to an exterior wall of the building, parallel thereto and vertically disposed. At each floor of the building, inclined access chutes from the building to the interior of the tube are provided. Platforms are mounted at intervals of a few feet within the tube for free pivotal movement between blocking and unblocking positions with respect to the interior thereof. A curved section at the lower end of the tube provides horizontal exit from the tube.

Means are provided for biasing the platforms toward rotation to the blocking position. In the illustrated embodiments, a counterweight is mounted on an arm attached to the pivot axis of the platform. The weight and moment arm provide a biasing force great enough to maintain the platform in its blocking position but are overcome by the weight of an individual resting on the platform, which causes pivotal movement thereof to the unblocking position, allowing the individual to drop a few feet to the next platform. The time required to overcome the inertia of the counterweight, together with the biasing force of the moment arm, provide decelleration and control the individual's rate of descent to succeeding platforms.

The openings in the building wall communicating with the inclined chutes are preferably covered by doors having a locking means selectively controlled from a station outside the building. Also preferably provided at each floor is an additional, smaller wall opening or vent normally covered by a door which is actuated to open in response to heat or smoke by a conventional detection device therefor. Thus, an operator at the control station outside the building may visually detect the opening of the door covering the vent, and/or smoke issuing therefrom, and actuate a switch releasing the locking mechanism of the door leading to the evacuation chute for that floor.

Means are also disclosed for varying the biasing force on the platforms in accordance with the weight of each individual to provide a constant rate of descent irrespective of weight. Indicator lights near the access doors may be connected to switches on the platforms to show when the platform at one or more higher levels is open. A mechanical interlock is also disclosed which prevents opening movement of one platform when the next lower, platform is open.

DETAILED DESCRIPTION

Figure 1:
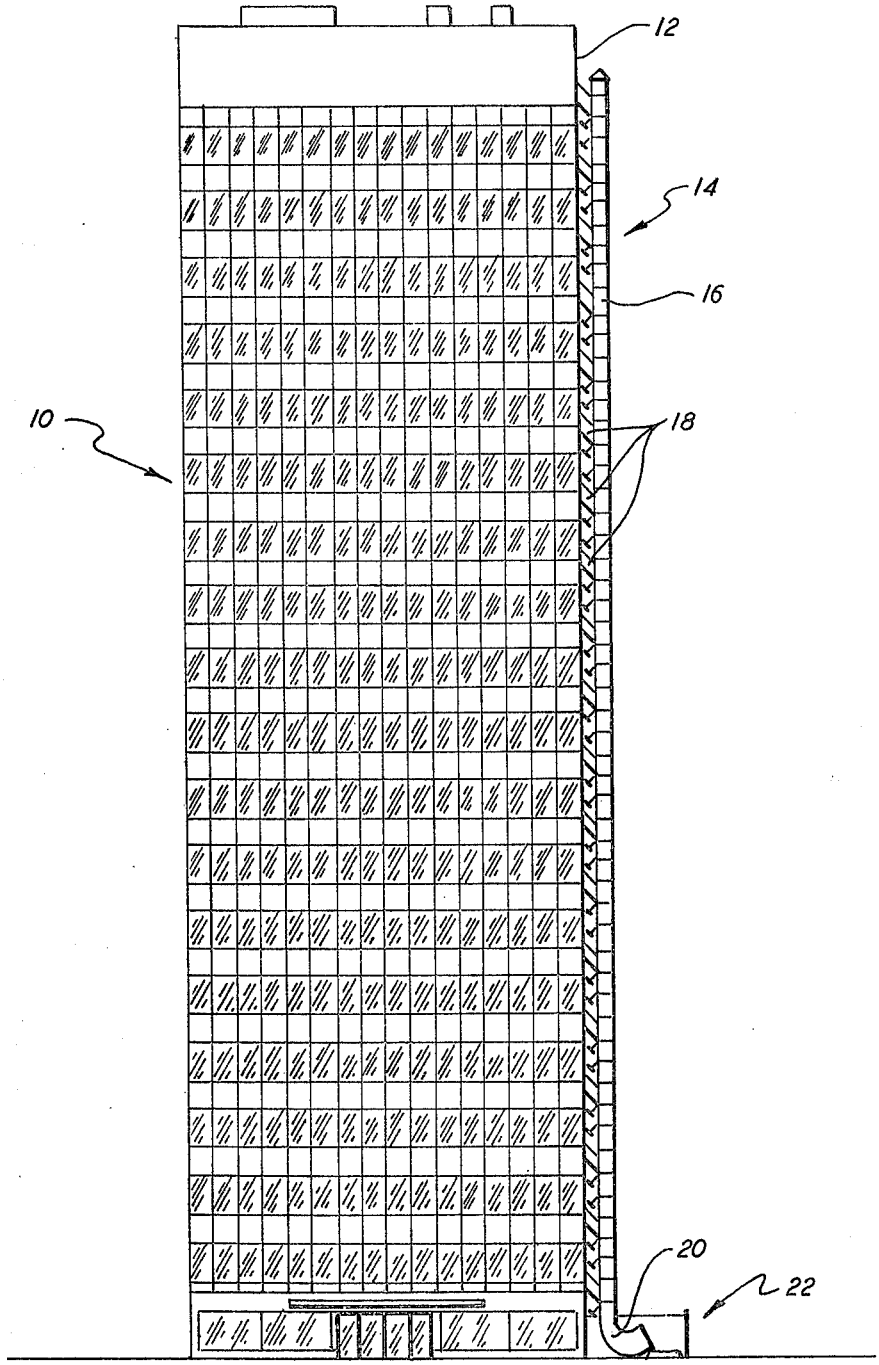
FIG. 1 is an elevational view of a high rise building with the emergency evacuation apparatus of the invention associated therewith.

Referring now to the drawings, in FIG. 1 is shown a high rise building 10 having a side wall 12 adjacent to the exterior of which the emergency evacuation apparatus of the invention, denoted generally by reference numeral 14, is installed. Apparatus 14 includes vertically disposed, hollow tube 16 spaced a few feet from wall 12, and inclined chutes 18, comprising hollow enclosures having upper ends communicating with the interior of building 10 at each floor thereof, and lower ends communicating with the interior of tube 16. The lower end of tube 16 includes curved section 20. Control station 22, the nature and operation of which will be explained later, is installed adjacent the lower end of the tube.

Figure 2:
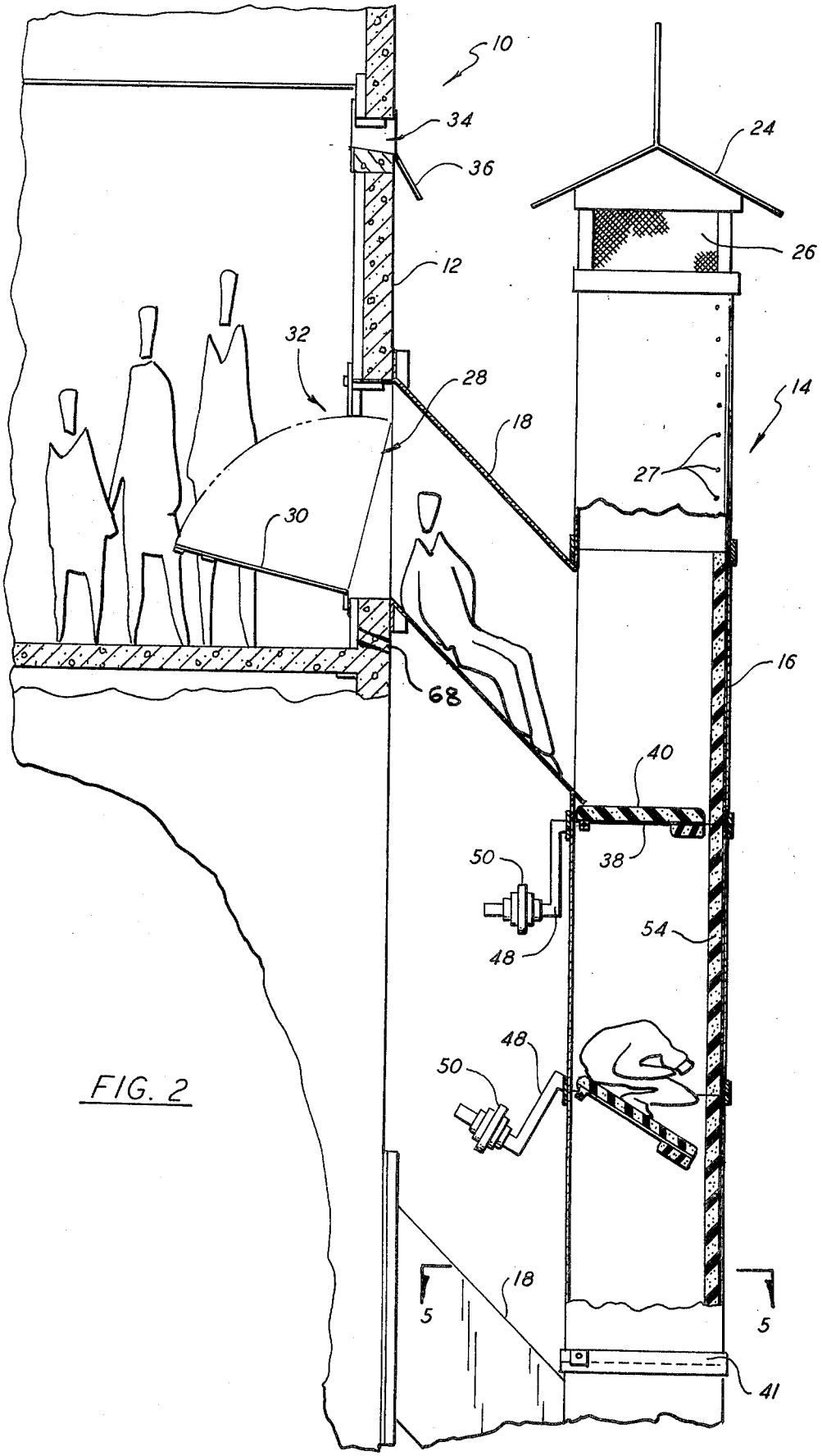
FIG. 2 is a fragmentary, side elevational view, partly in section, of a portion of the building and an upper portion of the evacuation apparatus, illustrating the manner of use thereof.

Turning now to FIG. 2, fragments of the upper portions of building 10 and apparatus 14 are shown with the apparatus in use by individuals being evacuated from the building. A top covering or dome structure 24 of any suitable construction, providing screened openings 26 on the sides for ventilation of tube 16. Small openings 27 are also provided down the length of tube 16 for ventilation purposes. An opening 28 in wall 12 at the top story of building 10 is normally covered by door 30, held in position by a locking mechanism of conventional design, denoted generally by reference numeral 32. An additional, smaller opening 34 is normally covered by door 36, hinged at the lower edge to the outside of wall 12, and held in the closed position by a locking mechanism actuated by smoke and/or heat within the space enclosed on one side by wall 12.

As seen from FIG. 2, when door 30 is in the open position, individuals may enter the upper end of chute 18 leading from opening 28 to the interior of tube 16. At the lower end of the chute is platform 38, preferably of steel having padded covering 40 on the upper surface thereof. Each floor of building 10 is provided with openings such as 28 and 34, shown at the top floor only in FIG. 2, and a platform 38 is mounted within tube 16 at the lower end of each chute 18. An additional platform is provided within tube 16 at a position approximately midway between the platforms at the bottom of each inclined chute. Thus, for standard building construction, platforms are installed about every 4 to 5 feet within tube 16, which may conveniently be fabricated in sections having a length corresponding to the platform spacing. Each tube section, therefore, contains one platform and is assembled to adjacent sections at joints 41. Since the construction and operation of each platform is the same, common reference numerals are used for all platforms and associated elements regardless of their vertical positions relative to tube 16.

Figure 5:
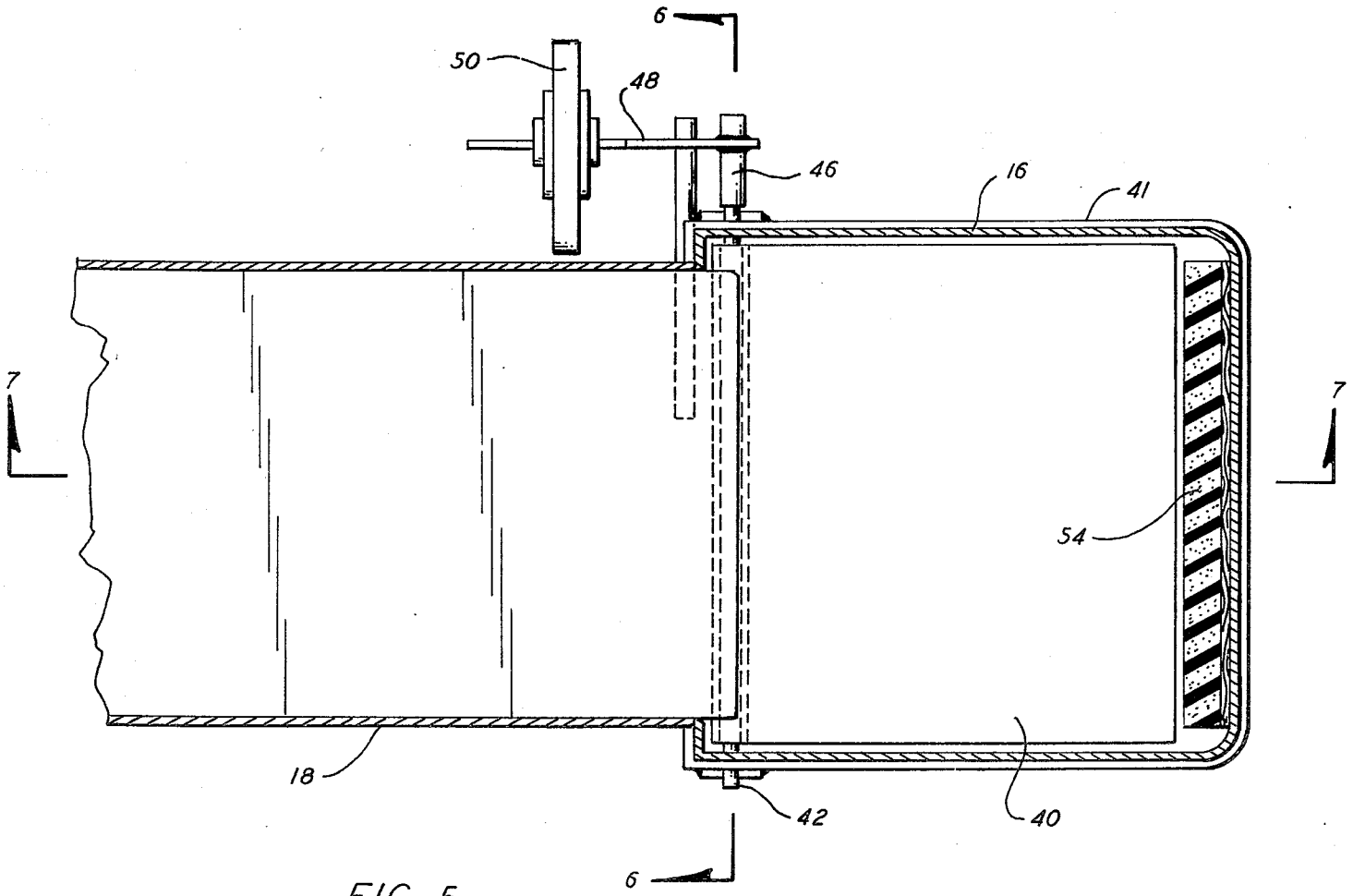
FIG. 5 is a plan view of the evacuation apparatus in section on the line 5—5 of FIG. 2.
Figure 6:
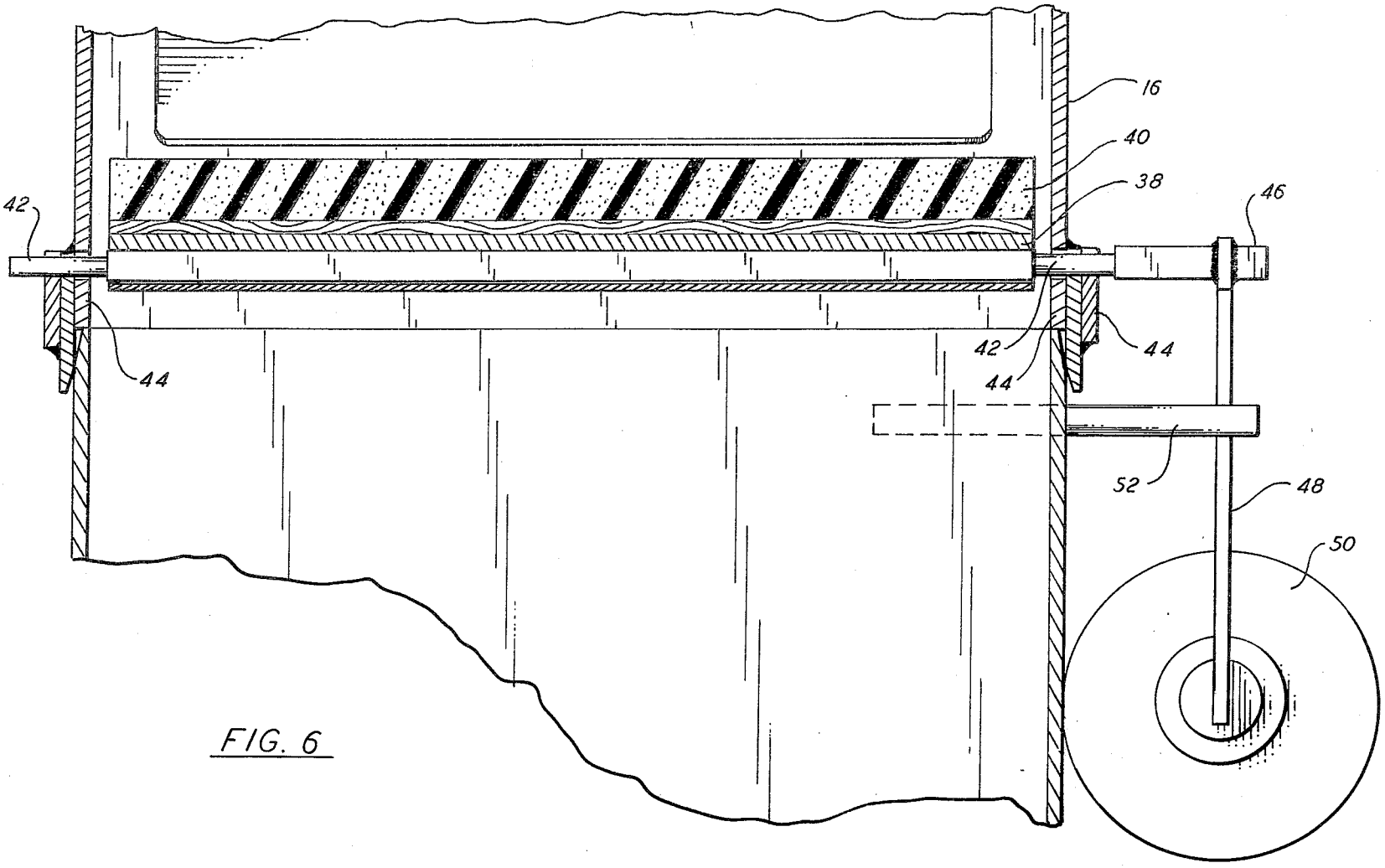
FIGS. 6 and 7 are fragmentary, sectional views taken on the lines 6—6 and 7—7, respectively, of FIG. 5.
Figure 7:
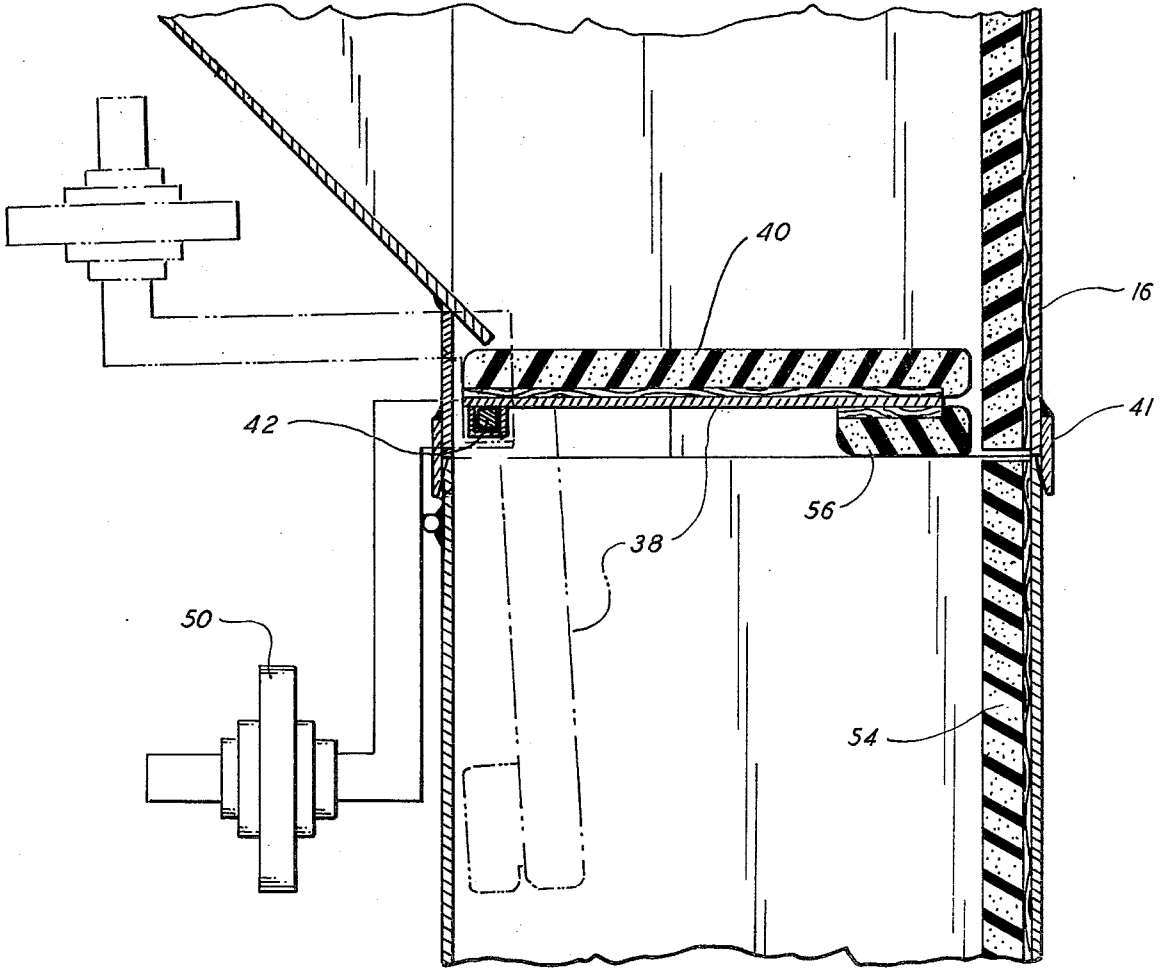

As seen more clearly in FIGS. 5–7, pins or rods 42 extend rigidly from the corners of platforms 38 closest to building 10 through the walls of tube 16 and are journaled in appropriate supports 44. On the end of one rod 42 is mounted sleeve 46 to which arm 48 is attached. Counterweight 50 is carried upon a rearwardly extending portion of arm 48, exerting a force about the axis of rods 42 opposing the weight of platform 38 and padding 40, thus tending to rotate the platform in a counterclockwise direction as viewed, for example, in FIGS. 2 & 7. Stop member 52 (FIG. 6) extends outwardly from tube 16 to prevent further rotation of arm 48 with platform 38 at a blocking position across the interior of the tube. In the illustrated embodiment, as seen in FIG. 5, tube 16 is approximately square in cross section.

Platforms 38 are freely pivotal upon rods 42 so that a weight on the upper side of the platform constituting a moment arm in excess of that provided by counterweight 50 will cause clockwise rotation of the platform toward an open or unblocking position with respect to the interior of tube 16. When an individual comes to rest upon the top of one of platforms 38 at the lower end of one of chutes 18, in a sitting position, his weight will overcome the inertia and moment arm provided by weight 50 and rotate the platform to an unblocking position, allowing him to drop a few feet to the next lower platform. The platform is pivotal at the edge nearest building 10, near which most of the individual's weight is concentrated since his back is toward the building. The weight and length of the lever arm formed by arm 48 and counterweight 50 are so adjusted that the moment arm provided by the individual's weight is not a great deal larger than that provided by counterweight 50. Thus, sufficient time is required in moving each successively lower platform from blocking to unblocking position that a controlled rate of descent is provided. Padding 54 covers the interior of the wall of tube 16 farthest from building 10, as shown in FIGS. 2 & 7, since this is the only wall against which any parts of the body of an individual descending through the tube are likely to contact. Padding 56 (FIG. 7) may, if desired, be attached to the lower surface of platforms 38.

It will be understood, of course, that the counterweights and moment arms of the illustrated embodiment are but one means of means of providing the necessary biasing force opposing movement of the platforms away from, and returning them to, the blocking position. Other well-known biasing means which could be suitably adapted to the present invention inlude frictional, pneumatic, hydraulic, magnetic and spring loading devices.

Figure 3:
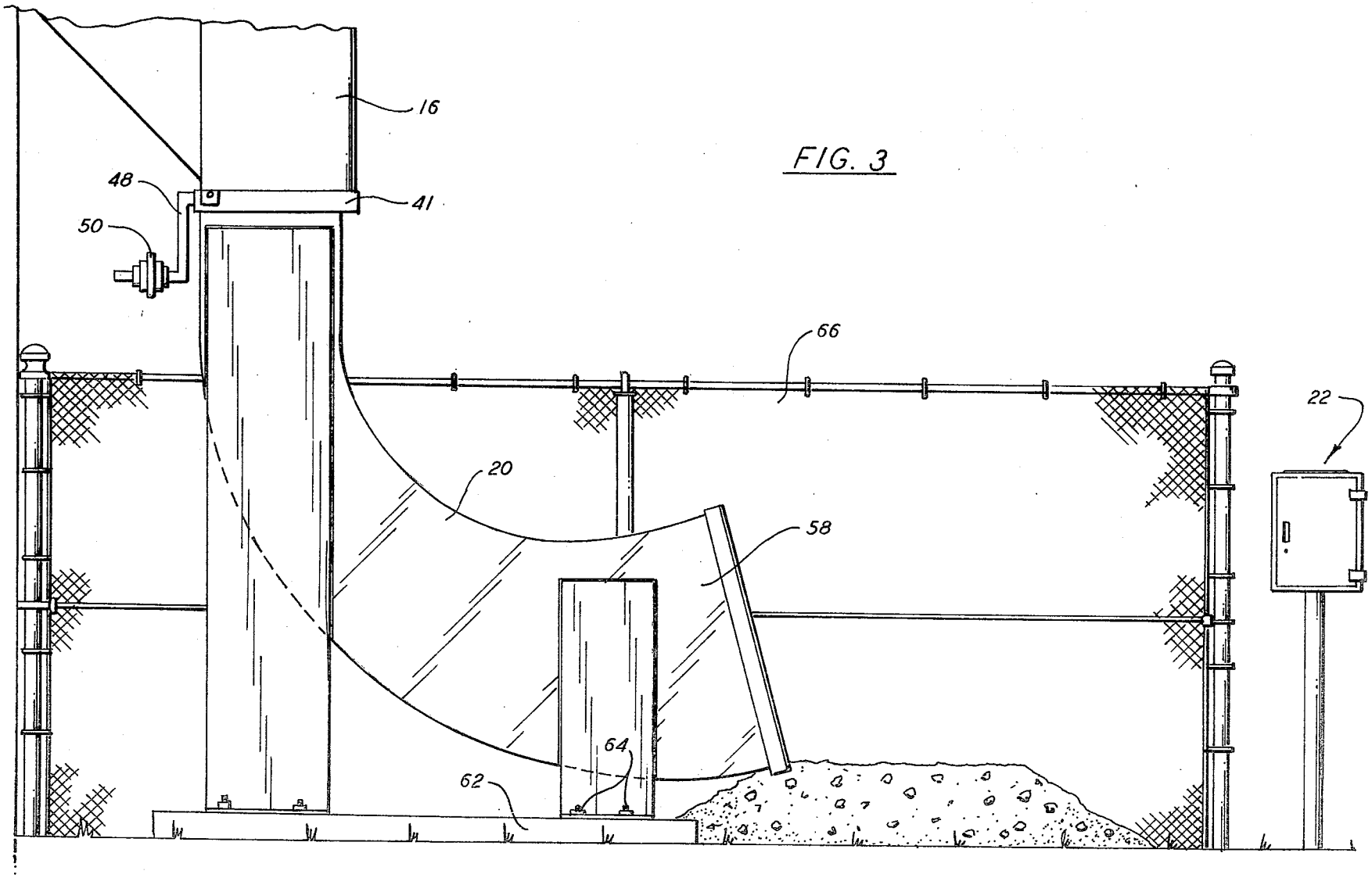
FIG. 3 is a side elevational view of the lower portion of the evacuation apparatus and control station.
Figure 4:
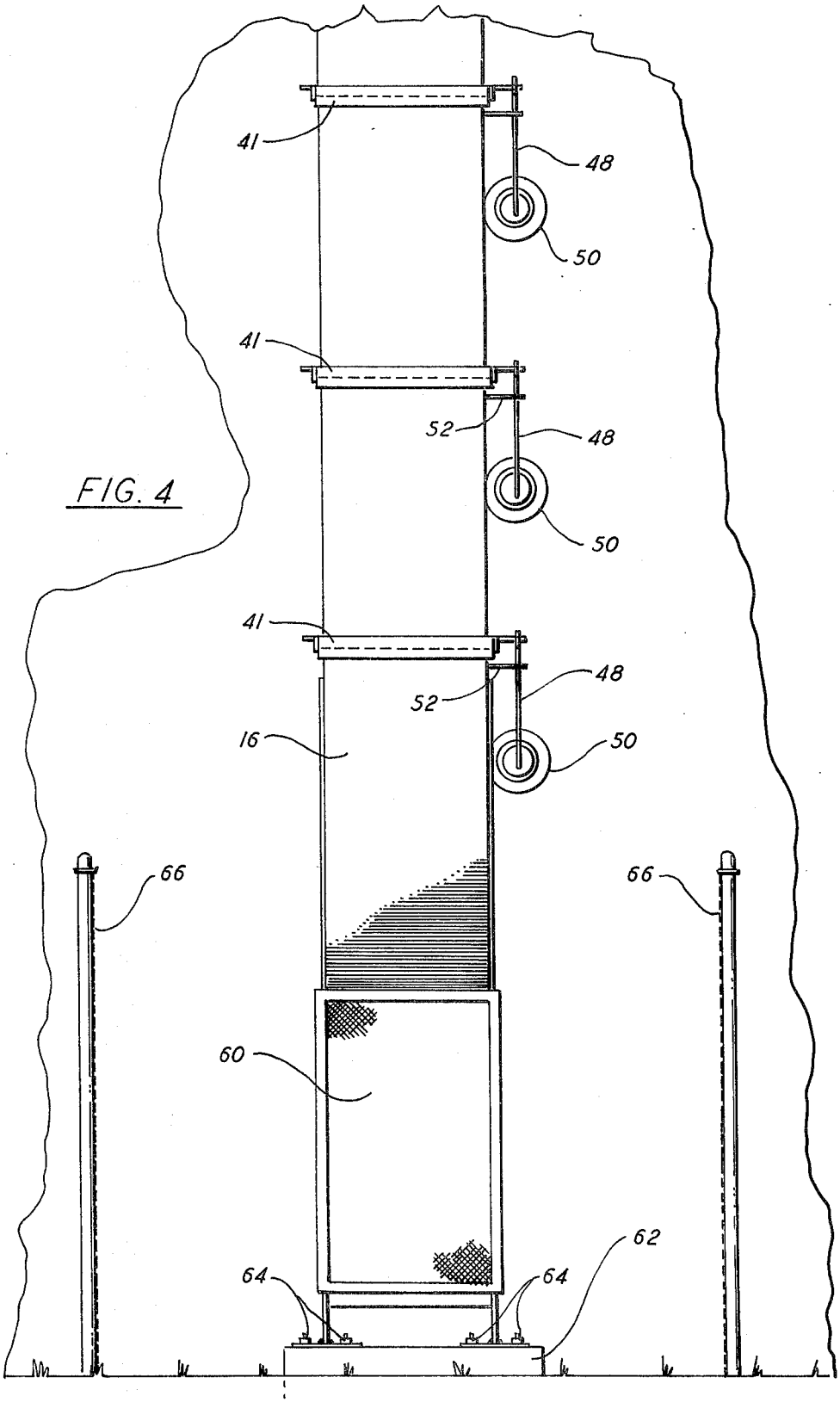
FIG. 4 is a fragmentary, front elevational view of the lower portion of the evacuation apparatus.

Curved section 20 at the lower end of tube 16, leads to a substantially horizontal outlet end 58 (FIG. 3) having an opening 60 (FIG. 4) permitting individuals to exit from the tube at ground level in a substantially upright position. Concrete pad 62 and bolts 64 are provided to anchor securely the lower end of the tube. Control station 22, as previously noted, is located near the lower end of tube 16, and contains appropriate switches for remote control of the locking mechanism 32 for doors 30 at each floor. Thus, opening of the doors is under the control of an operator outside the building. Doors 36 and the vent openings which they cover are visible to an operator at station 22 so that he may selectively actuate the switches to open doors 30 on those floors where smoke or heat has caused door 36 to open. Thus, except under conditions of extreme emergency, only one floor at a time will be evacuated so that the apparatus will not be loaded in excess of its capacity. Necessary wiring for the door actuators, as well as an emergency telephone system, may be provided through suitable conduits attached to the outside of tube 16 and top and bottom of inclined chutes 18. Fence 66 may be provided to enclose the exit section 58, if desired. In fact, the entire apparatus 14 may be suitably enclosed in pierced masonry, a metal grill, or the like, for architectural compatibility with building 10. The entire system may be adapted to virtually any existing or new structures with minor modifications, if required. It is also preferred that water drain openings 68 (FIG. 2) be provided at or near floor level at each story.

Figure 8:
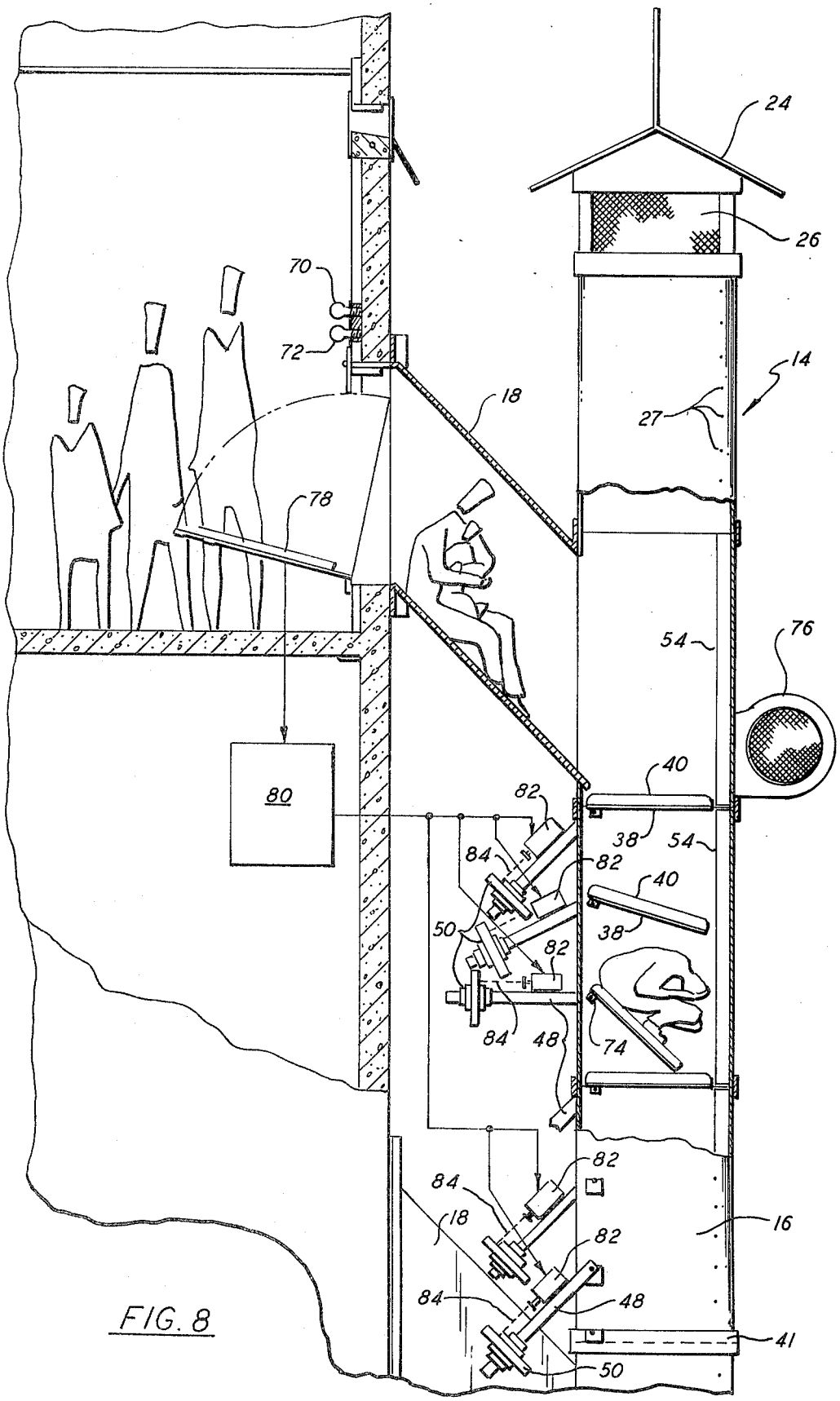
FIG. 8 is a fragmentary, side elevational view, partly in section, of the upper part of the building and another embodiment of the invention.
Figure 9:
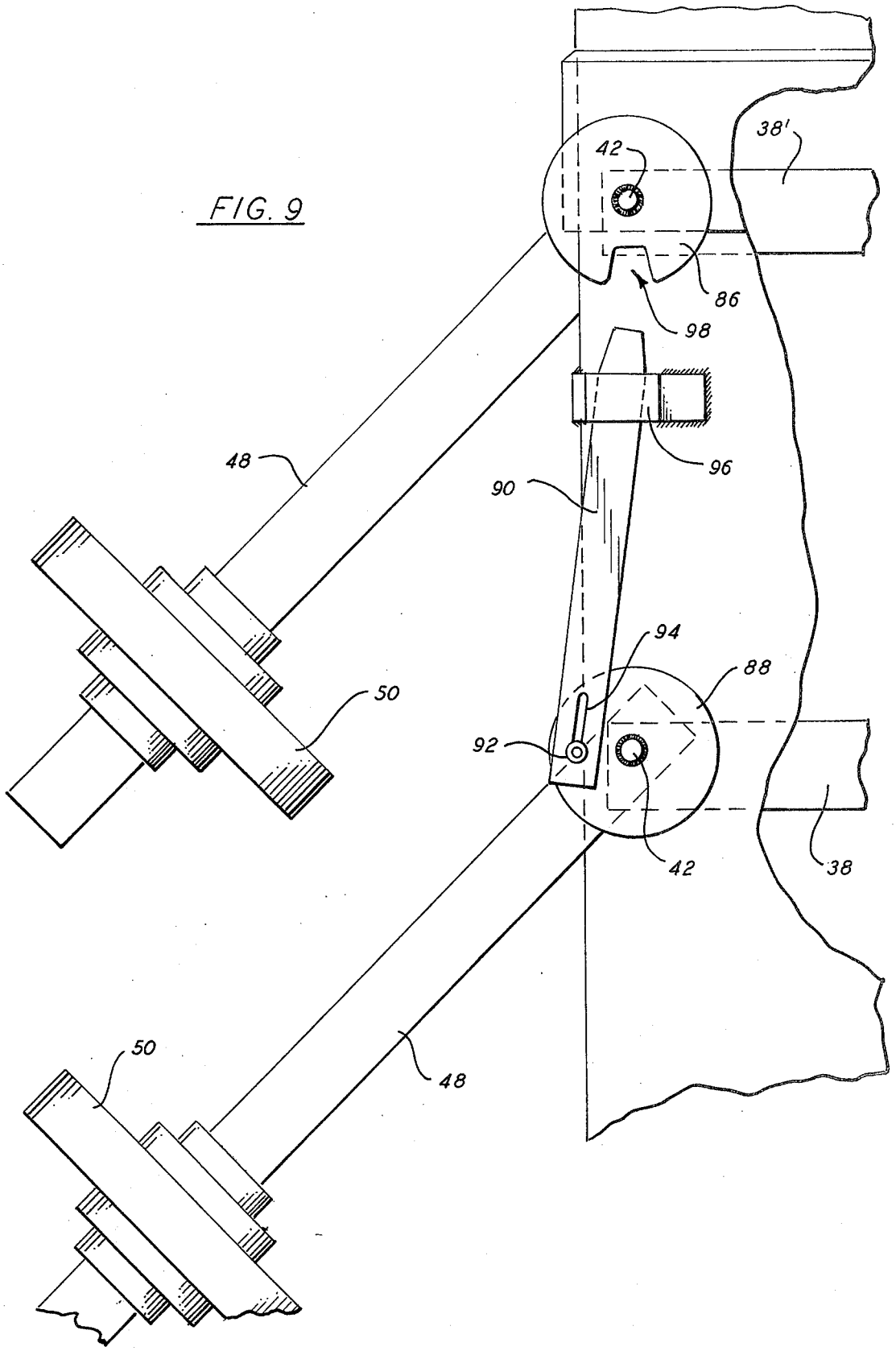
FIG. 9 is a somewhat enlarged, side elevational view of a portion of the apparatus showing still another construction.

The constructions illustrated in FIGS. 8 and 9 include a number of additional features which may be incorporated, if desired, to further enhance operational characteristics. For convenience and clarity, the same reference numerals are used for elements of the FIG. 8 and 9 embodiment which may be structurally identical to elements of the previously described embodiment. It will be noted that arms 48 extend straight from the platform pivot rods at about a 45° angle rather than vertically downward and then horizontally, as in the previous embodiment. Also, since platforms 38 are more closely spaced, successive arms and counterweights are mounted on opposite sides of chute 16.

On the interior of wall 12, above or otherwise adjacent each access door 30, are red and green lights 70 and 72. Small mechanical switches 74 are associated with some or all or platforms 38 for movement between first and second positions as the platforms pivot away from and back to the blocking position within chute 16. For example, switches 74 may be so located with respect to the platform and some fixed portion of the structure that they are held in the first position when the platform is in its blocking position and moved under a spring bias to the second position upon movement of the associated platform away from its blocking position. Switches 74 are wired in the circuits of lights 70 and 72 so that power is provided to the green light when the switches associated with one or more platforms at higher levels are in the blocking position and to the red light when such platforms are in the unblocking position. Each set of lights may be connected in circuit with only the switch at the next succeeding higher level, or with the switches at several succeedingly higher levels, depending upon the desired time factor. An indication is thus provided to the individuals at each level before entering the chute to prevent interference with other individuals already in the act of making a descent.

Another desirable feature is the provision of vent fans 76 mounted upon the outside of chute 16 to direct air into and through the chute to keep the latter, as well as inclined chutes 18, ventilated and relatively free of smoke. Fans 76 may be mounted at each floor, or at any desired vertical spacing.

Also diagrammatically shown in FIG. 8 is means for adjusting the bias on platforms 38 to provide a constant rate of descent irrespective of the weight of the individual. That is, with the system previously described, although a safe rate of descent may be provided for all individuals within a normally anticipated range of weights, the actual rate will obviously vary for individuals of different weights if the bias on the platforms is constant. Although various means may be provided to change the bias, just as different means are available for providing the bias, the illustrated means are employed in conjunction with the basic structure of the previously described embodiment.

Appropriate scale means, indicated by block 78, are associated in any convenient manner with each of doors 30 so that the weight of an individual sitting or standing on the door in preparation for entering inclined chute 18 may be indicated. Scale means 78 include a conventional transducer for converting the mechanical scale deflection or the force produced by the individual's weight into an electrical signal commensurate with the weight. This signal is fed to a computer, indicated by block 80, appropriately constructed and programmed to provide output signals to servo motors 82 associated with the biasing means of each of platforms 38. The output signals are scaled in accordance with the input signals representing the weight so that motors 82 adjust the biasing force opposing movement of the platform away from the blocking position by an amount providing a substantially constant relationship between the biasing force and the individual's weight. In the illustrated form, the necessary adjustment may be made by a positional adjustment of counterweights 50 to vary the moment arm opposing movement of the platforms away from the blocking position. The actual movement may be transmitted from motors 82 to counterweights 50 in any desired manner, such as a threaded connection through which rotational movement of the motor is translated to linear movement of the counterweights, or by other conventional linkages. The connection providing the positional adjustment of the weights in response to movement of the motors is generally denoted in FIG. 8 by reference numeral 84.

An example of a mechanical interlock system for the platforms is shown in FIG. 9. Arms 48 supporting weights 50 are keyed to pivot rods 42 of platforms 38 and extend therefrom at approximately a 45° angle, rather than being bent at 90° as in the first-described embodiment. This feature, however, is optional in either construction. The platforms at the lower end of each of inclined chutes 18, one such platform being shown in FIG. 9 and denoted by reference numeral 38', are provided with collar 86 keyed to pivot rod 42. Circular plate 88 is keyed to the pivot rod of the next lower platform 38 and carries arm 90, pivotally secured to the plate by locking bolt 92. Elongated slot 94 allows adjustment of the linear position of arm 90 upon plate 88. Guide strap 96 directs the free end of arm 90 toward slot 98 in collar 86. When platform 38 rotates to the open or unblocking position, plate 88 rotates to bring the free end of arm 90 into slot 98. Rotation of collar 86, and thus of pivot rod 42 and platform 38', is prevented until the end of arm 90 is withdrawn from slot 98 by rotation of platform 38 back toward the blocking position. Thus, the interlock system prevents one individual from overtaking another within chute 16 by preventing movement of one platform to the unblocking position if the next lower platform has not begun movement back to the blocking position, which it cannot do if an individual has not yet cleared the platform and moved to a still lower level.

What is claimed is:

1. Apparatus for emergency evacuation of occupants from a multi-story building through openings in a side wall thereof, said apparatus comprising, in combination:

a. a substantially vertical, hollow tube extending in fixed, parallel relation to the building side wall;

b. means through which the interior of said tube communicates with the interior of the building at each floor thereof;

c. A plurality of platform means mounted at predetermined intervals along the length of said tube for movement between blocking and unblocking positions wth respect to the interior thereof;

d. biasing means associated with each of said platform means urging the latter toward said blocking position and providing a biasing force opposing movement of said platform means away from said blocking position; and e. means for automatically adjusting the biasing force on said platforms in response to the weight of an individual to provide a substantially constant rate of movement of said platforms to said unblocking position irrespective of the weight of the individual.

2. The invention according to claim 1 wherein said predetermined distance is on the order of a few feet.

3. The invention according to claim 2 wherein said biasing means comprises a weight mounted on a lever arm.

4. The invention according to claim 3 wherein said platform means are each mounted for pivotal movement about an axis between said blocking and unblocking positions.

5. The invention according to claim 4 wherein said weight and lever arm are mounted for pivotal movement about said axis.

6. The invention according to claim 5 and further including a curved portion at the lower end of said tube leading to a substantially horizontal exit section.

7. The invention according to claim 5 wherein said weight and lever arm are mounted externally of said tube.

8. The invention according to claim 1 wherein said communicating means comprises an inclined chute extending between an opening in said building side wall and an opening in the wall of said tube.

9. The invention according to claim 8 and furter including door means normally retained in covering relation to said building wall opening by locking means.

10. The invention according to claim 9 wherein said locking means are electrically actuated to allow uncovering movement of said door means and further including a remote station at which said locking means are actuable.

11. The invention according to claim 9 wherein said door means includes a panel so arranged when moved to uncover said building wall opening to allow entry of an individual into said inclined chute, the individual's weight is placed upon said panel, and further including means associated with said panel for sensing weight placed thereon.

12. Apparatus for emergency evacuation of occupants from a multi-story building through openings in a side wall thereof, said apparatus comprising, in combination:

a. a substantially vertical, hollow tube extending in fixed, parallel relation to the building side wall;

b. means through which the interior of said tube communicates with the interior of the building at each floor thereof;

c. a plurality of platform means mounted at predetermined intervals along the length of said tube for movement between blocking and unblocking positions with respect to the interior thereof;

d. biasing means associated with each of said platform means urging the latter toward said blocking position and providing a biasing force opposing movement of said platform means away from said blocking position;

e. interlock means preventing movement of each platform away from the blocking position when the next succeedingly higher platform is in the unblocking position.

13. Apparatus for emergency evacuation of occupants from a multi-story building through openings in a side wall thereof, said apparatus comprising, in combination:

a. a substantially vertical, hollow tube extending in fixed, parallel relation to the building side wall;

b. means through which the interior of said tube communicates with the interior of the building at each floor thereof;

c. a plurality of platform means mounted at predetermined intervals along the length of said tube for movement between blocking and unblocking positions with respect to the interior thereof;

d. biasing means associated with each of said platform means urging the latter toward said blocking position and providing a biasing force opposing movement of said platform means away from said blocking position;

e. indicating means on the interior of the building adjacent each of said communicating means and responsive to the position of at least one of said platforms at a level higher than the respective indicating means.

* * * * *